US007344170B2

(12) United States Patent
Ingram

(10) Patent No.: US 7,344,170 B2
(45) Date of Patent: Mar. 18, 2008

(54) FRICTION GRIP FIREPLACE TOOL

(76) Inventor: Todd Russell Ingram, 19330 Attala Rd. 4101, West, MS (US) 39192

( * ) Notice: Subject to any disclaimer, the term of this patent is extended or adjusted under 35 U.S.C. 154(b) by 0 days.

(21) Appl. No.: 10/829,080

(22) Filed: Apr. 22, 2004

(65) Prior Publication Data

US 2005/0236852 A1 Oct. 27, 2005

(51) Int. Cl.
*F24B 15/00* (2006.01)

(52) U.S. Cl. ..... 294/11; 294/26

(58) Field of Classification Search ..... 294/61, 294/9–11, 14, 15–17, 19.1, 19.2, 19.3, 26, 294/27.1; 43/5
See application file for complete search history.

(56) References Cited

U.S. PATENT DOCUMENTS

| | | | | | |
|---|---|---|---|---|---|
| 1,281,708 | A | * | 10/1918 | Thayer | 294/17 |
| 1,489,581 | A | * | 4/1924 | Lynch | 294/100 |
| 3,042,438 | A | | 7/1962 | Turner | |
| 3,124,383 | A | | 3/1964 | Cahan | |
| 3,310,331 | A | | 3/1967 | Michaud | |
| 3,574,380 | A | | 4/1971 | Tague | |
| 4,141,579 | A | * | 2/1979 | Moss | 294/61 |
| 4,240,657 | A | | 12/1980 | Feighery | |
| 4,355,831 | A | | 10/1982 | Smith | |
| 4,449,743 | A | | 5/1984 | Pankratz | |
| 4,560,194 | A | | 12/1985 | Rybeck | |
| 4,715,632 | A | * | 12/1987 | McVey | 294/19.1 |
| 4,762,303 | A | * | 8/1988 | Thomas | 254/25 |
| 4,783,926 | A | * | 11/1988 | McKinney et al. | 43/5 |
| 4,889,375 | A | | 12/1989 | Leu | |
| 4,955,647 | A | | 9/1990 | Alfredson | |
| 5,277,579 | A | * | 1/1994 | Takanabe | 432/5 |
| 6,457,756 | B2 | | 10/2002 | Pronesky | |
| 6,571,505 | B1 | * | 6/2003 | Poiencot, Jr. | 43/5 |
| 2002/0171252 | A1 | * | 11/2002 | Bystrom | 294/17 |
| 2004/0016170 | A1 | * | 1/2004 | Fitzgibbons | 43/5 |
| 2005/0110289 | A1 | * | 5/2005 | Myers | 294/10 |

* cited by examiner

*Primary Examiner*—Saul Rodriguez
*Assistant Examiner*—Paul T Chin
(74) *Attorney, Agent, or Firm*—Townsend & Banta

(57) ABSTRACT

A friction grip fireplace tool comprising a rod or bar, having a hand grip on one end, and on the other end a resilient, unary, v-shaped open-jawed mouth to grip, lift and re-position logs in a fireplace. There are no moving parts, no hinges, or pivot points. The tool can be made of one solid piece of steel or material with similar properties of elasticity and fire resistance or can be fabricated from two or more parts. A log is held in place by friction, created by ridges within the open-jawed mouth of the tool and the spring effect of the open-jawed mouth being forced onto a log. The spring effect of the tool's mouth along with the friction effect of the ridges allow most burning logs to be completely lifted, held, and moved about safely.

5 Claims, 4 Drawing Sheets

FRICTION GRIP FIREPLACE TOOL

CROSS REFERENCES TO RELATED APPLICATIONS

Not applicable

STATEMENT REGARDING FEDERALLY SPONSORED R & D

Not applicable

REFERENCE TO SEQUENCE LISTING, A TABLE, OR COMPUTER PROGRAM LISTING APPENDIX

Not applicable

BACKGROUND OF THE INVENTION

This invention relates to log handling tools for a fireplace. It is a unique tool, different from conventional fireplace tools such as tongs, hooks, or pokers. Each of these have their limitations in moving about a burning log and cause the user some difficulty. Tongs require moving parts that must be manipulated by the user to acquire and retain a grip while at the same time exerting force with both hands to lift and move the log. They are difficult to get between burning logs, and do not provide the user an adequate mechanism to grip and lift a heavy log. Hooks are difficult to get between logs and have no mechanism to grip the log. They work best only in a pulling motion, making it difficult for the user to move a log rearward or upward in a fireplace. Conventional wedge or pointed tipped pokers only allow a log to be pushed about but not lifted.

Various types of log handling tools are known in the prior art. A typical example of such a log handling tool is to be found in U.S. Pat. No. 3,042,438, issued to J. Turner on Jul. 3, 1962. This patent discloses a fireplace tool including an elongated metal rod having a transverse leg at one end for manipulating a fireplace log. U.S. Pat. No. 3,310,331 issued to H. Michaud on Mar. 12, 1967, discloses a U-shaped hook having a D ring type handle for manipulating a log. U.S. Pat. No. 3,574,380, issued to R. Tague on Apr. 13, 1971, discloses a fireplace log handling tool including two separate arms, each of which is manipulated by a user to engage opposite end faces of a log. Each of the arms terminates in a transverse leg having a pointed tip. U.S. Pat. No. 4,560,194 issued to T. Rybeck on Dec. 24, 1985, discloses a log-handling tool for mounting upon an axe-type handle. The tool includes a laterally extending hook member having an offset tip portion. U.S. Pat. No. 4,773,686, issued to H. Michaud on Sep. 27, 1988, disdoses a wood handling hook having a tip including a set of flutes forming shoulders to enhance engagement of a log. U.S. Pat. No. 4,955,647 issued to H. Alfredson on Sep. 11, 1990 discloses a log-handling hook bent a 90 degrees. None of these devices uses a resilient, unary, v-shaped, open-jawed mouth, and friction ridges within the mouth, to grip and lift a log, as does the current invention.

BRIEF SUMMARY OF THE INVENTION

This invention overcomes problems of the prior art by allowing the user to conveniently lift and move a burning log in any direction and release the log in any position. The log is held by the spring effect created when the open-jawed mouth, lined with friction ridges, joined to the end of a long sturdy rod, is pushed onto a log. The tool is easy to use and has no moving parts. A user can grip a log with a single pushing motion, then lift and move the log in any direction without any need to manipulate moving parts or apply any force to retain the grip.

In view of known disadvantages in other types of log handling tools, this invention provides a substantial advancement in fireplace tools. When properly used, the open mouth is pressed onto a burning log. The elasticity of the resilient material of the unary, v-shaped, open-jawed mouth (typically iron or steel) allows the mouth to be forced to open wider as it is pushed onto the log. The resilient, unary mouth exhibits a spring effect that resists the forced opening with progressively increasing forces on the sides of the log. The spring effect of the mouth, along with friction ridges inside the mouth, create friction sufficient to firmly grip a log, which may then be lifted, moved about in the fireplace, or completely removed from a fireplace. Unlike hooks, tongs, and conventional pokers, this tool provides a solid grip on the log, and is easy to insert between logs. This tool may also be used to very quickly grip and lift a burning log that rolls out of a fireplace. No other tool exists to handle this very difficult and urgent task.

DETAILED DESCRIPTION

Figure 1:
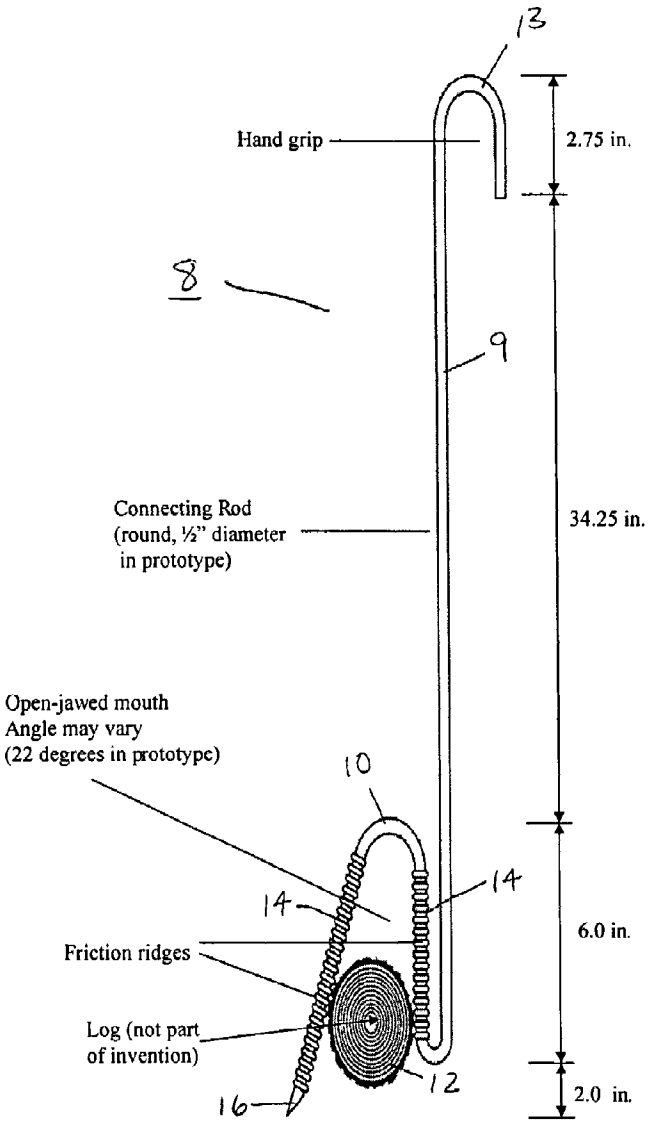
FIG. 1 is a side view of the friction grip fireplace tool of the present invention. The dimensions of the tool shown in FIG. 1 are those of the prototype tool that has been built and tested successfully. However, other dimensions may be equally effective for other constructions. Details such as the shape of the hand grip at the upper end of the tool, the method of attachment of the hand grip, the method of construction of the open-jawed mouth, or the method of attachment of the mouth may vary from FIG. 1. This figure is not drawn to scale.
Figures 2, 3, 4, 5:
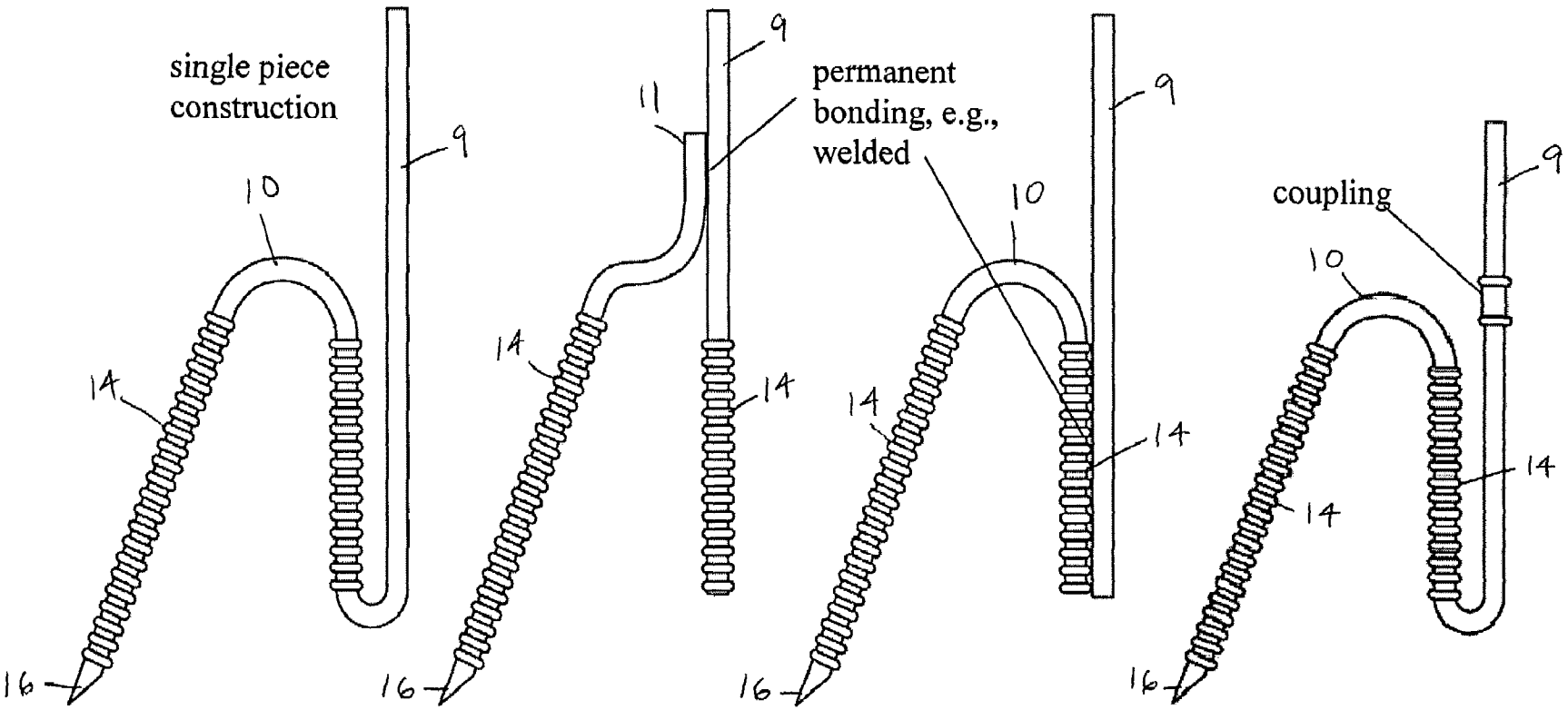
FIG. 2 is a partial side view of the friction grip fireplace tool of the present invention, illustrating the open-jawed mouth of a tool having a single-piece construction.
FIG. 3 is a partial side view of the friction grip fireplace tool of the present invention, illustrating an embodiment of the present invention wherein the open-jawed mouth of the tool has a welded construction, and having friction ridges disposed on both a welded portion 11 and the connecting rod 9.
FIG. 4 is a partial side view of the friction grip fireplace tool of the present invention, illustrating an embodiment of the present invention wherein the open-jawed mouth of the tool has a welded construction, and having friction ridges 14 disposed only on a welded portion 11.
FIG. 5 is a partial side view of the friction grip fireplace tool 8 of the present invention, illustrating an embodiment of the present invention wherein the open-jawed mouth 10 of the tool is coupled to the connecting rod 9 via a coupling.

The applicant's invention, as illustrated in FIG. 1, provides a fireplace tool 8 to be used to grip, lift, reposition and release burning logs. A burning log is gripped with this tool 8 by placing the open-jawed mouth end 10 of the tool 8 near the center of the log 12 and pushing the mouth 10 firmly against the log 12. The open-jawed mouth 10 is unary in that it is constructed of a single structural element, with no pivot points, joints or moving parts in the mouth (or the entire tool). Constructed of steel or a material with similar modulus of elasticity, the unary mouth 10 acts as a v-shaped spring that resists the forced widening of the mouth's opening. Pushing the resilient, unary, v-shaped, open-jawed mouth 10 over a fire log 12 thus produces a spring effect, i.e., the sides of the mouth spring back against the log 12, and the friction ridges 14 around the inner perimeter of the mouth 10 produce a pronounced friction effect upon the log 12. The combination of the spring effect and the friction effect cause the mouth 10 to grip a log 12 tightly, allowing a burning log to be conveniently lifted, moved about and released, without manipulating any levers, tongs or moving parts. A ¼ round, ½ round, or whole round log can be conveniently handled with this tool. Tapping the mouth 10 of the tool 8 against another log, the firebox, grate, dog irons, or any other solid object in the fireplace releases the log into position.

FIGS. 9 through 12 illustrate an example of use of the tool 8. The sequential numbering of the following description corresponds to the numbers shown in these figures.

1. The pointed tip 16 disposed on one side of the mouth 10 is pushed under the log 12 to be lifted.
2. The mouth 10 is pushed onto the log 12.
3. The force of the push of the mouth 10 against the log 12 causes the mouth 10 to open in a manner consistent with the elasticity of the tool material (e.g., steel). The spring force resisting the opening of the mouth 10 creates gripping force on the log 12, and the friction ridges 14 within the mouth 10 enhance the grip, preventing the log 12 from slipping out of the open end of the mouth 10.
4. The grip of the tool 8 on the log 12 allows the log 12 to be lifted and moved freely.
5. The log 12 is moved to a new position in the fireplace.
6. The pointed tip 16 of the mouth 10 is tapped against an object in the fireplace, thereby causing the mouth 10 to release the log 12.
7. The log 12 is released into the new position.

Although there are other tools to stir fires or lift logs such as conventional pokers and tongs, this tool is unique in that it uses no moving parts to grip and completely lift a burning log. No other tool uses friction ridges that are forced into the wood by the spring action created by the open-jawed mouth and the elasticity of the mouth material.

This tool 8 can be fabricated from one solid piece of steel or other fire-resistant material with a similar modulus of elasticity, with a hand grip 13 on one end, and on an end opposite the hand grip 13, the open-jawed mouth 10. In this one-piece embodiment of the tool 8 the open-jawed mouth 10 is formed by a double bend in the connecting rod 9 (see FIG. 1). The first bend turns the end of the connecting rod 9 back toward the handle grip 13 180 degrees, or parallel to the connecting rod 9. The second bend turns the connecting rod 9 end at an angle from parallel to the connecting rod 9. In the embodiment of the present invention (which is a working prototype) shown in FIG. 1, that angle is 22 degrees. The most effective angle for a given will depend on the tool material used, the size of the connecting rod 9, and the size of the mouth opening 10, which may be varied for different constructions. The tool 8 shown in FIG. 1 may be made of a single piece of steel, metal or other material having appropriate elasticity (similar to steel) and properties to withstand the heat of a fire. Around the inner perimeter of the mouth 10 of the tool 8 are a series of friction ridges 14, the spacing of which may vary with different constructions. On the working prototype shown in FIG. 1, the friction ridges 14 are spaced approximately ¼ inch apart. The force exerted by these friction ridges 14, along with the spring effect of the mouth 10, create the necessary friction to grip and lift logs.

In a one-piece construction of the tool 8, the exact location of the bends can be altered to change the size of the mouth opening 10. Using a prototype construction of the tool 8, the applicant has found that the dimensions shown in FIG. 1 create a mouth opening that is a good size to lift logs of various sizes. The pointed tip 16 of the tool 8 extends about 2 inches past the first bend and serves as a wedge to allow a user to force the tool between logs.

Figure 8:
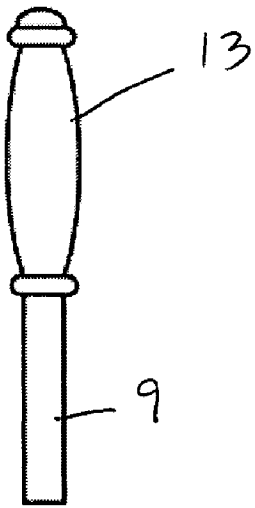
FIG. 8 is a partial side view of the friction grip fireplace tool of the present invention, illustrating an embodiment of the hand grip wherein the hand grip 13 is uncurved and contiguous with the connecting rod 9.
Figure 7:
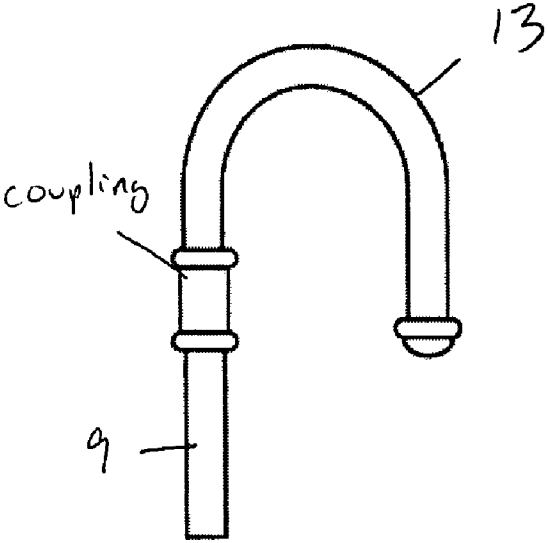
FIG. 7 is a partial side view of the friction grip fireplace tool of the present invention, illustrating an embodiment of the hand grip 13 wherein the hand grip is a U-shaped hand grip coupled to the connecting rod 9 of the tool via a coupling.
Figure 6:
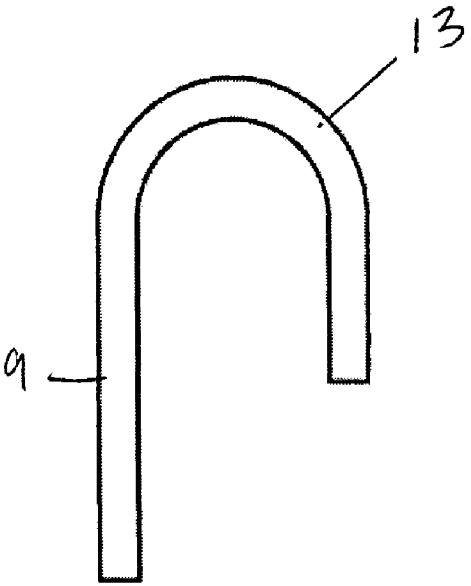
FIG. 6 is a partial side view of the friction grip fireplace tool of the present invention, illustrating an embodiment of the hand grip wherein the hand grip 13 is a U-shaped hand grip formed contiguously with the connecting rod 9 of the tool.
Figures 9, 10, 11, 12:
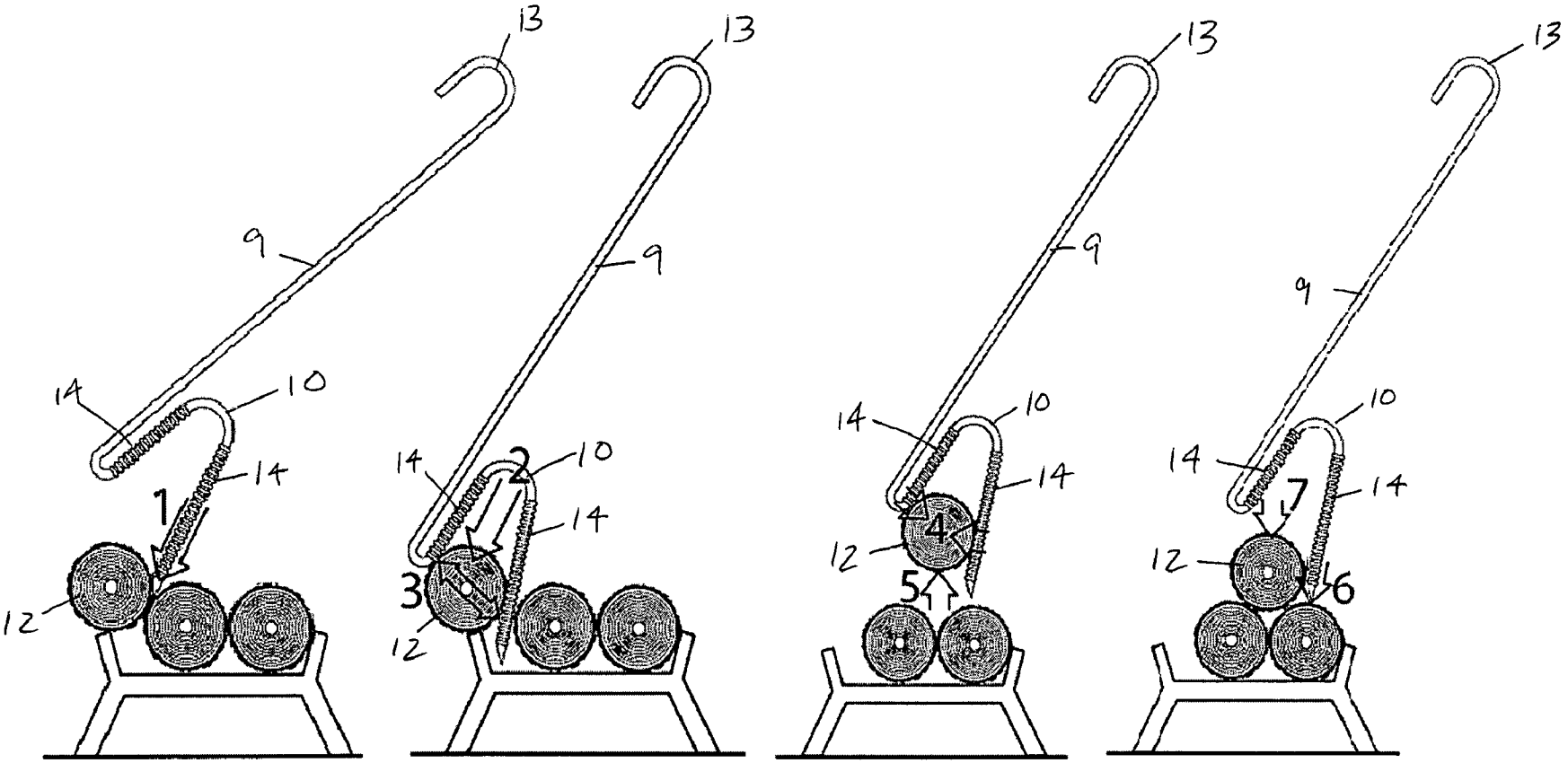
FIG. 9 is a side view illustrating a first step in an operation to move a log using the friction grip fireplace tool of the present invention, wherein the numerical label "1" serves as a reference for the textual description of the process used with the tool of the present invention in the Detailed Description of the Invention, and wherein the arrow illustrated direction of movement of the tool.
FIG. 10 is a side view illustrating a second step in an operation to move a log using the friction grip fireplace tool of the present invention, wherein the numerical labels "2" and "3" serve as references for the textual description of the process used with the tool of the present invention in the Detailed Description of the Invention, and where the small arrow illustrates the direction of force applied by the log, and the larger arrow illustrates the direction of force applied by the tool.
FIG. 11 is a side view illustrating a third step in an operation to move a log using the friction grip fireplace tool of the present invention, wherein the numerical labels "4" and "5" serve as references for the textual description of the process used with the tool of the present invention in the Detailed Description of the Invention, wherein the opposing arrows illustrate the directions of force applied by the open-jawed mouth 10 of the tool, and the up pointing arrow adjacent numeral "5" illustrates the direction of movement of the log 12 being gripped by the tool.
FIG. 12 is a side view illustrating a fourth step in an operation to move a log using the friction grip fireplace tool of the present invention, wherein the numerical labels "6" and "7" serve as references for the textual description of the process used with the tool of the present invention in the Detailed Description of the Invention, wherein the arrow adjacent numeral "7" illustrates the direction of travel of the log 12, and wherein the arrow adjacent numeral "6" illustrates the direction of force applied by the tool 8.

The tool can also be fabricated in a variety of ways from multiple parts. See FIGS. 2 through 5 for examples of constructions of the open-jawed mouth end of the tool and FIGS. 6 through 8 for example constructions of the hand grip end. A hand grip of wood, brass, or other material may be used.

What I claim as my invention is:

1. A friction-grip fireplace tool, comprising:

a. a unary, v-shaped, flexible open-jawed mouth having a closed end defining an outer perimeter, and an open end defined by an inner perimeter, said inner perimeter comprised of:

i. a first straight portion having a first end, a second end, and a middle portion therebetween, ii. a curved portion having a first end and a second end, the first end of the curved portion being connected to the second end of the first straight portion; and iii. a second straight portion having a first end, a second end, and a middle portion therebetween, the first end of the second straight portion being connected to the second end of the curved portion, said unary, v-shaped, flexible open-jawed mouth exhibiting a spring-like effect when the first straight portion and the second straight portion are urged apart;

b. friction ridges disposed on the first straight portion from the first end to the second end thereof, and on the second straight portion from the first end to the second end thereof, said friction ridges creating a non-piercing friction effect upon an object disposed within the inner perimeter of the open end of said open-jawed mouth when the first straight portion and second straight portion are urged apart by said object;

c. an elongated connecting rod having an upper end and a lower end, said second end of said second straight portion being connected to said connecting rod at its lower end such that the closed end of said open-jawed mouth is directed toward a user of said fireplace tool, d. a hand grip; and e. means of joining said hand grip to said connecting rod at its upper end, whereby a user can grip said fireplace tool by said hand grip, and push said open-jawed mouth onto said object, thus applying a progressively tightening gripping force upon said object via the combination of said spring-like effect and said non-piercing friction effect provided by the friction ridges, enabling the user to lift, move, reposition and release said object without manipulating any moving parts.

2. The friction-grip fireplace tool of claim 1, further including a wedge-shaped tip disposed as an in-line extension of the first end of the first straight portion of said inner perimeter of the open-jawed mouth.

3. The friction grip fireplace tool of claim 1, wherein said open-jawed mouth is made of steel.

4. The friction-grip fireplace tool of claim 1, wherein said open-jawed mouth is made of iron.

5. The friction-grip fireplace tool of claim 1, wherein said fireplace tool is constructed by joining together said open-jawed mouth, said elongated connecting rod, and said hand grip.

* * * * *